US005334994A

United States Patent [19]

Takagi

[11] Patent Number: 5,334,994

[45] Date of Patent: Aug. 2, 1994

[54] IMAGE DISPLAY DEVICE HAVING MULTI-WINDOW SYSTEM

[75] Inventor: Shiro Takagi, Yokohama, Japan

[73] Assignee: Kabushiki Kaisha Toshiba, Kawasaki, Japan

[21] Appl. No.: 859,959

[22] Filed: Mar. 30, 1992

[30] Foreign Application Priority Data

May 21, 1991 [JP] Japan ..... 3-116100

[51] Int. Cl.[5] ..... G09G 5/26

[52] U.S. Cl. ..... 345/127; 345/120

[58] Field of Search ..... 340/731, 728, 721, 724, 340/723; 345/127, 129, 130, 131, 120, 119; 358/183; 382/47; 395/139

[56] References Cited

U.S. PATENT DOCUMENTS 4,806,919 2/1989 Nakayama et al. ..... 340/721
5,079,724 1/1992 Shiraki et al. ..... 340/731
5,151,974 9/1992 Tani et al. ..... 340/724

FOREIGN PATENT DOCUMENTS 59-501842 11/1984 Japan .
344732 2/1991 Japan .

*Primary Examiner*—Tommy P. Chin
*Assistant Examiner*—A. Au
*Attorney, Agent, or Firm*—Cushman, Darby & Cushman

[57] ABSTRACT

When an image is enlarged or reduced at a predetermined magnification and then the enlarged or reduced image is displayed on a display window whose part is shielded from another window, a work memory corresponding to the size of the display window is secured, image data is first enlarged or reduced by an enlargement/reduction circuit and transferred onto the secured work memory. The image data transferred onto the work memory is stored as it is in a region on a display memory for storing a content displayed on a display, the region corresponding to the display window. Even when an unshielded part of the display window includes a plurality of rectangular regions, the enlargement or reduction processing can be performed at once, with a result that an image can be clearly displayed without causing any shift between any two images on the rectangular regions.

3 Claims, 4 Drawing Sheets

| WINDOW ID | DISPLAY ORDER | WINDOW NAME | WINDOW DISPLAY STARTING POINT | | WINDOW SIZE | |
|---|---|---|---|---|---|---|
| | | | X | Y | X | Y |
| 1 | 2 | Wa | 100 | 100 | 400 | 330 |
| 2 | 1 | Wb | 350 | 300 | 350 | 300 |

38a

F I G. 2

IMAGE DISPLAY DEVICE HAVING MULTI-WINDOW SYSTEM

BACKGROUND OF THE INVENTION

1. Field of the Invention

The present invention relates to an image display device using a multi-window system in which a plurality of images can be displayed simultaneously on regions or regions of a display.

2. Description of the Related Art

Recently, image display devices, which adopt a multi-window system for displaying images on specified regions of a screen called windows, have been widely used.

The image display devices are able to execute a plurality of application programs simultaneously and selectively display the application programs or execution results thereof on different windows. A case where the input and output application programs are displayed on windows overlapping each other, will be described with reference to FIG. 5. As shown in FIG. 5, part of a display window 1 on which an image is to be displayed is partly shielded from a window 2. Regions (A) and (B) of image data corresponding to regions (1) and (2) of the window 1 which are not shielded from the window 2, are detected, and data of the regions (A) and (B) are transferred to their corresponding regions (1) and (2), respectively, with a result that the images in the regions (A)and (B) are displayed on the window 1.

In such an image display device, there is a case where original image data is displayed on a window as an enlarged or reduced image. In this case, the enlargement or reduction processing is executed when data is transferred as described above.

Since the enlargement or reduction processing is generally executed independently for each data of the regions (A)and (B), images of the regions (1) and (2) corresponding to the regions (A) and (B)are shifted from each other between these regions by an error in the enlargement or reduction processing.

More specifically, when the image data differs in size from the window on which the image is to be displayed, in other words, when the regions (A) and (B) of the image data differ in size from the regions (1) and (2) of the window 1, respectively, the enlargement or reduction processing is executed independently for each of the regions (A) and (B). Even though the seeming magnifications of enlargement or reduction of the two regions (A) and (B) are the same, a slight difference occurs between the magnifications since the conditions for omitting the decimals of the magnifications are different. Therefore, the images of the regions (1) and (2) are shifted from each other after the enlargement or reduction processing is executed.

SUMMARY OF THE INVENTION

It is therefore an object of the present invention to provide an image display device in which part of a display window on which an image is to be displayed is shielded from another window and the other unshielded part of the display window includes a plurality of rectangular regions and which allows a clear image to be displayed without disturbance or shift when the original image is enlarged or reduced on the unshielded part.

To attain the above object, an image display device according to the present invention comprises:

processing means for enlarging/reducing image data to be displayed in windows of a display at predetermined magnifications;

determination means for determining how a display window overlaps other window of the windows;

memory means for temporarily storing the image data obtained by the processing means when the determination means determines that part of the display window is shielded from the other window and an unshielded part of the display window includes at least two rectangular display regions; and control means for displaying image data stored in the memory means, which corresponds to the unshielded part of the display window.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention.

FIG. 2 is a view showing examples of contents stored in a window control table of the electronic filing device shown in FIG. 1;

DETAILED DESCRIPTION OF THE PREFERRED EMBODIMENTS

An embodiment of the present invention will be described with reference to the accompanying drawings.

Figure 1:
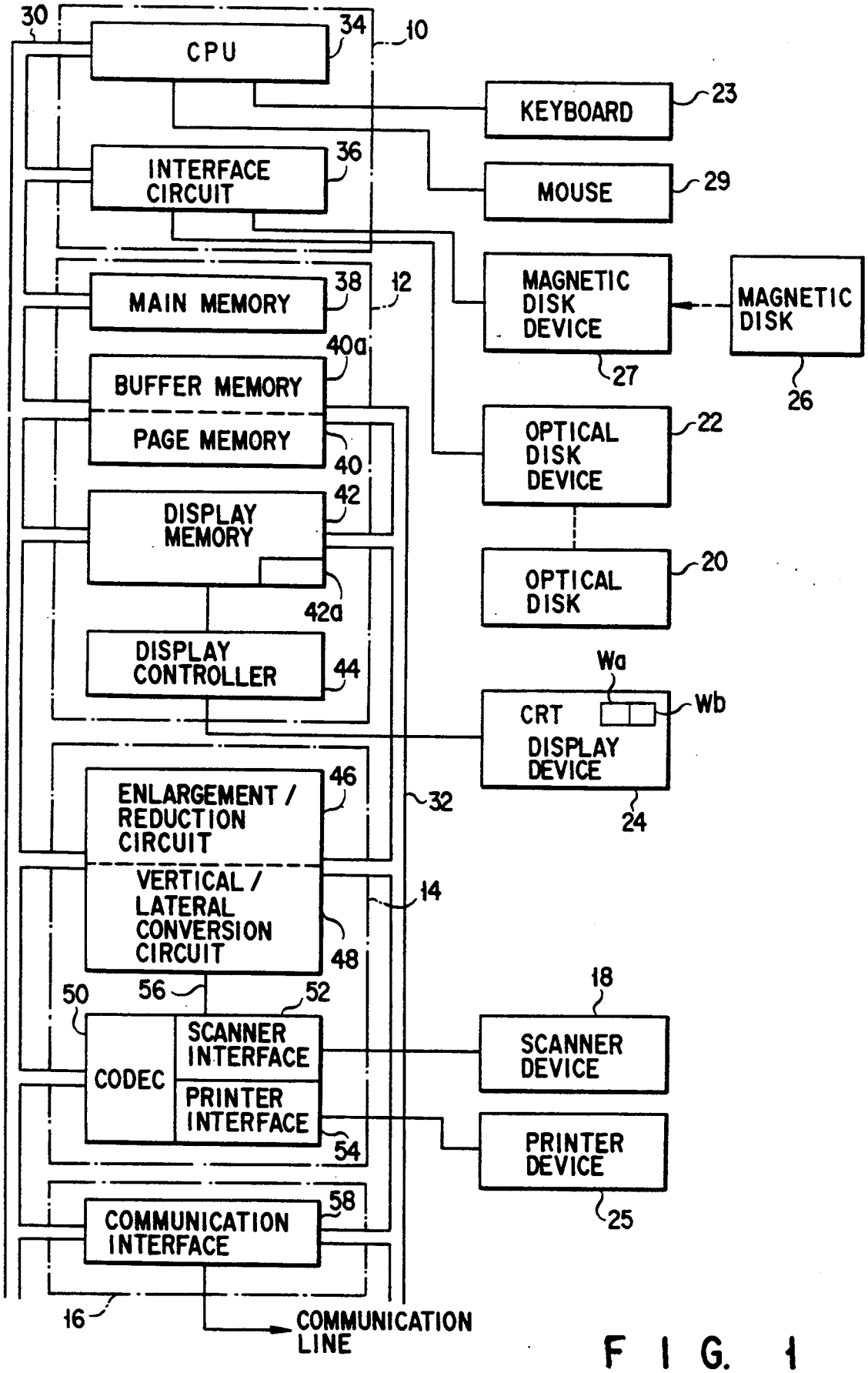
FIG. 1 is a block diagram showing an electronic filing device by way of example of an image display device according to an embodiment of the present invention.

FIG. 1 shows a block diagram of one embodiment of an electronic filing device according to the present invention.

The electronic filing device comprises a control module 10, a memory module 12, an image processing module 14, a communication control module 16, a scanner device 18, an optical disk device 22, a keyboard 23, a cathode-ray tube (CRT) display device 24, a printer device 25, a magnetic disk device 27, a mouse 29, a system bus 30, and an image bus 32.

The CRT display device 24 displays an image read out from a manuscript by the scanner device 18 and an image read out from an optical disk 20 by the optical disk device 22. The CRT display device also displays an icon on the upper, lower, and right ends on its screen.

In the CRT display device 24, a plurality of regions having an arbitrary size and called a window, are designated and displayed at an arbitrary position on the screen. For example, windows Wa and Wb are displayed so that part of the window Wa is shielded from the window Wb.

The control module 10 includes a CPU 34 for controlling image storage, retrieval, editing, and the like, and an interface circuit 36 connected to the optical disk device 22, magnetic disk device 27, and CPU 34. The keyboard 23 and mouse 29 are connected to the CPU 34.

The memory module 12 includes a main memory 38 for storing various control programs and window control table (described later) for controlling the image storage, retrieval, editing, and the like, a page memory 40 serving as an image memory having a memory capacity of images corresponding to several A4-sized sheets, a display memory 42 serving as a display interface, and a display controller 44.

The page memory 40 temporarily stores image data, which is to be stored in or read out from the optical disk 20, and is provided with a buffer memory region 40*a*.

The display memory 42 temporarily stores image data to be displayed within a display window of the CRT display device 24. More specifically, image data stored in the page memory 40 is subjected to an enlargement, reduction, rotation, insertion, or white-and-black reversal operation and then stored in a predetermined image memory region of the display memory 42.

The display memory 42 includes a work memory 42*a* in addition to the image memory region. The operation memory 42*a* is as large as a display window on which an image is to be displayed.

The display controller 44 controls a display processing of the CRT display device 24.

The image processing module 14 comprises an enlargement/reduction circuit 46 for enlarging/reducing an image, a vertical/lateral conversion circuit 48 for rotating an image, a compression/expansion (CODEC) circuit 50 for executing a coding processing of image data compression (reduction in redundancy) and a decoding processing of image data expansion (recovery of redundancy), a scanner interface 52 connected to the scanner device 18, a printer interface 54 connected to the printer device 25, and an internal bus 56 for connecting the enlargement/reduction circuit 46 and vertical/lateral conversion circuit 48 with the compression/expansion circuit 50, scanner interface 52, and printer interface 54.

The compression/expansion circuit 50 compresses-/expands a band width using a Modified Huffman (MH) method or a Modified Read (MR) method.

The communication control module 16 includes a communication interface 58 such as a bus communication processor (BCP) connected to a communication line such as a local area network (LAN). The communication control module 16 can be provided with a universal communication processor (UCP) connected to an external device such as a facsimile communication processor (FCP) and a personal computer via an interface.

The system bus 30 transmits a control signal and connects the control module 10 to the memory module 12, image processing module 14, and communication control module 16.

The image bus 32 transmits image data and connects the memory module 12 to the image processing module 14 and communication control module 16.

The scanner device 18 is a two-dimensional scanning device for two-dimensionally scanning a manuscript (document or original) with a laser beam to generate an electrical signal corresponding to an image on the manuscript.

The optical disk device 22 sequentially stores images read out by the scanner device 18 and also retrieves an image designated by the keyboard 23 and corresponding to a retrieval code from the optical disk 20.

The keyboard 23 serves to input a retrieval code proper to an image recorded in the optical disk 20, and an instruction for storage, retrieval, editing or the like.

The mouse 29 moves a cursor (not shown) on the surface of the CRT display device 24 up, down, right and left to select and designate a displayed content (e.g., various operation modes, areas for image edition, or icons) at a desired position on the display screen.

The printer device 25 prints out an image read out by the scanner device 18, an image retrieved from the optical disk 20, or an image displayed on the CRT display device 24. (The printer device produces a hard copy.)

The magnetic disk device 27 stores various control programs in a magnetic disk 26 attached thereto and also stores retrieval codes input by the keyboard 23 and retrieval data (retrieval information) including a memory address on the optical disk 20 in which images corresponding to the retrieval codes are stored, an image size, and a retrieval repetition rate.

FIG. 2 shows contents stored in the window control table 38*a*.

The window control table 38*a* controls the display environment or a condition of the windows of the CRT display device 24, and has items of window identification, display order, window name, window display starting point, and window size for each of the windows.

In the item of the display order, "1" represents the highest order and, in other words, "1" represents that an image is displayed (this image is not shielded by any other window images). As the numerical value of the window ID increases, the display order becomes lower, and an image is displayed by another appear order window images.

In the items of the window display starting point and window size, not only the display position and window size, but also the overlap of windows and the actual display area of an unshielded region, are determined.

An operation of the electronic filing device having the above structure will be described.

Figure 3:
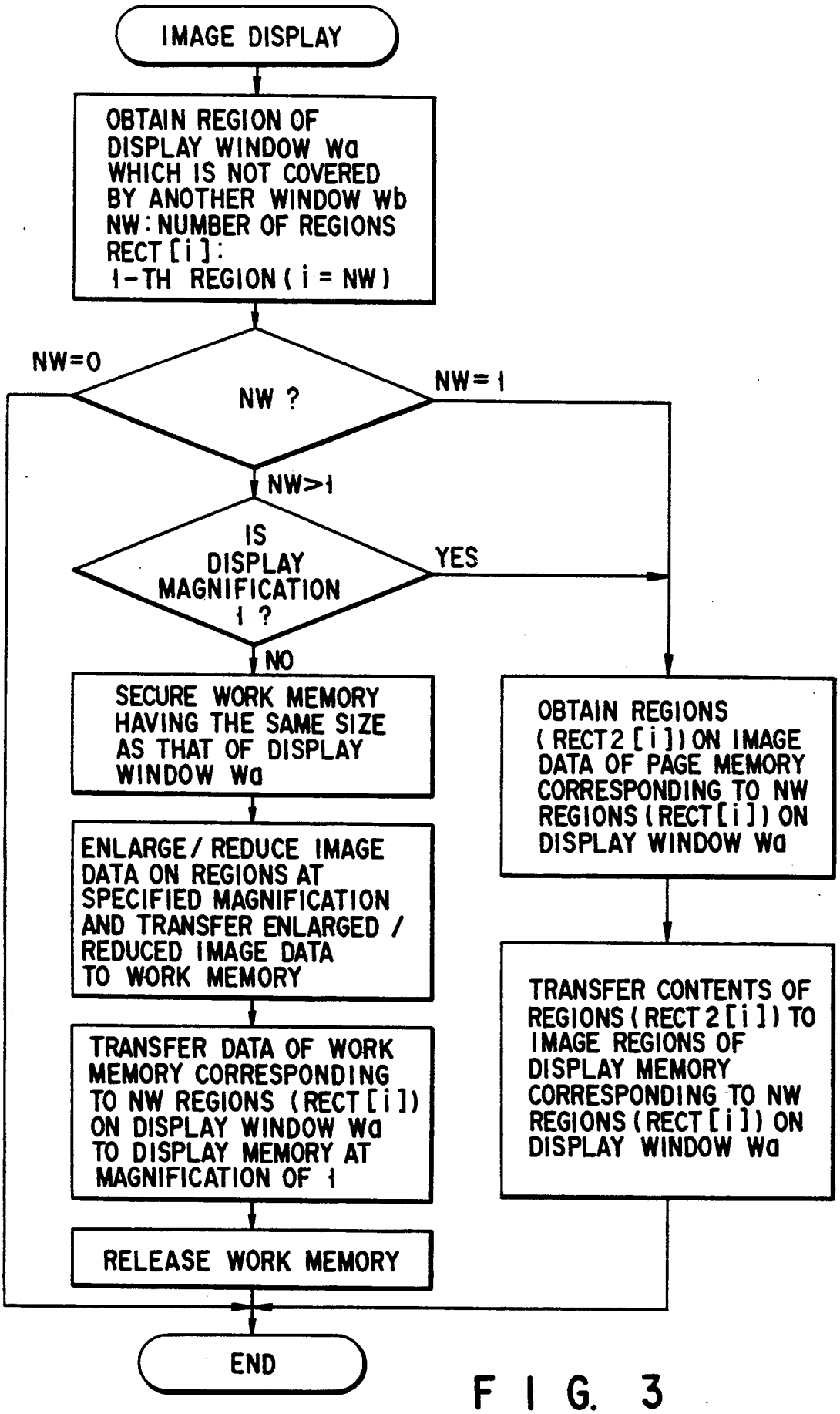
FIG. 3 is a flowchart showing an operation of the embodiment shown in FIG. 1.

FIG. 3 shows a flowchart in a case where image data stored in the page memory 40 is displayed on the CRT display device 24 as the window Wa.

Figure 4:
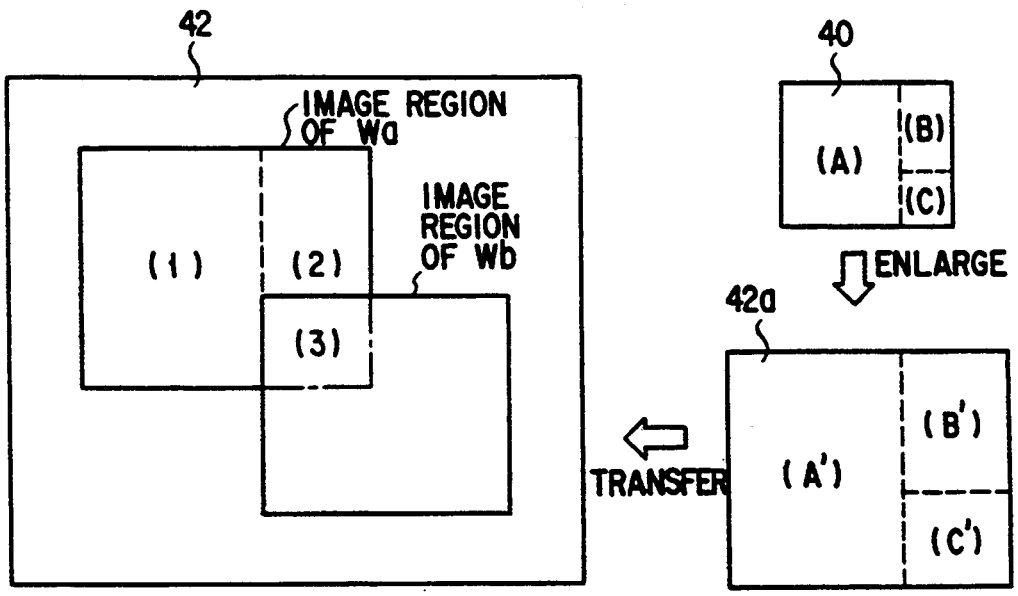
FIG. 4 is a view for explaining the operation of the embodiment shown in FIG. 1.
Figure 5:
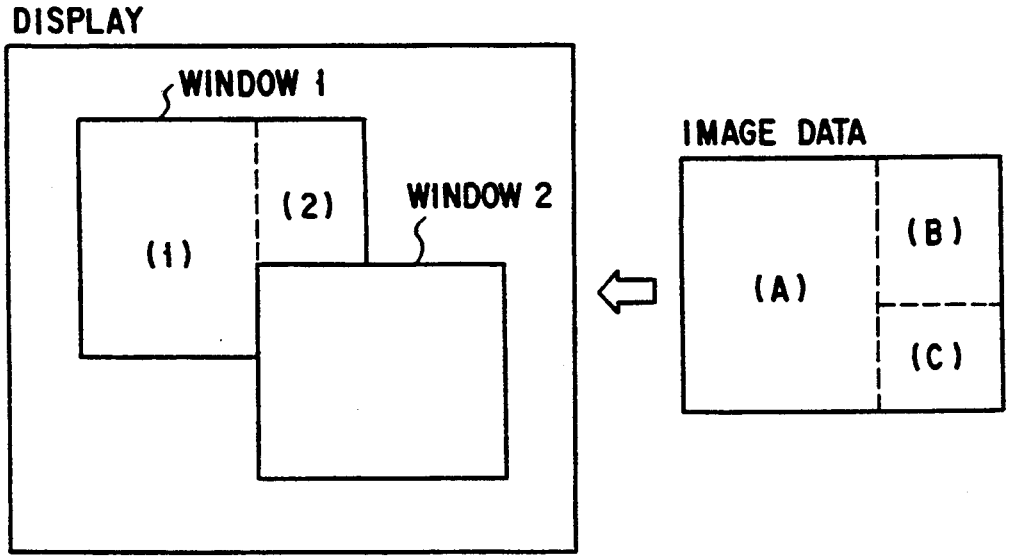
F I G. 5 (PRIOR ART)
FIG. 5 is a view showing one example of a multi-window of a conventional image display device.

For example, when the window Wb is in the highest display order, as shown in FIG. 2, and an image is displayed on the display window Wa which is overlapped by the window Wb as shown in FIG. 4, the CPU 34 divides a region of the window Wa, which is not shielded by the window Wb, into rectangular regions and calculates the number, the minimum number, for example, of the rectangular regions. The way of calculating the number of the divided rectangular regions is disclosed in, for example, PCT/US83/01452 to which the reference is made.

Assume that the number of the rectangular regions is represented by NW and each of the regions is represented by RECT[i]. [i] is an index indicative of the first to NW-th regions.

When the number of the regions is 0 (NW=0), the display window Wa is completely shielded from the window Wb and, in this case, the CPU 34 does not perform any operations, and display processing ends.

When the number of the regions is more than 1 (NW>1), the CPU 34 performs the following operation.

The CPU 34 determines a display magnification for the enlargement or reduction processing in accordance with the size of the image data stored in the page memory 40 and that of the display window Wa.

If the magnification is not 1, the CPU 34 secures the work memory 42*a* having the same size as that of the window Wa in the display memory 42, and then enlarges or reduces image data in accordance with the magnification determined by the CPU 34.

If the window Wa is larger than the size of image data to be displayed, as shown in FIG. 4, the image data stored in page memory is not divided into rectangular regions but is enlarged as large as the size of the work memory 42*a* to store the enlarged image data into the work memory 42*a*.

The CPU 34 then transfers the partial image data (A') and (B') on the work memory 42*a* to image regions (1) and (2) on the display memory 42 corresponding to NW regions (RECT[i]) on the target window Wa at a magnification of 1 and store them therein. The image data stored in each of the image regions (1) and (2) of the display memory 42 is thus displayed on the window Wa of the CRT display device 24.

The CPU 34 releases the work memory 42*a* and ends the display processing.

The reduction processing in which the size of the window Wa is smaller than that of the original image data stored in the page memory 40 and the image data is thus reduced to be displayed on the window Wa, is performed in the same manner as described above.

when image in the page memory 40 is as large as the size of the window Wa, and the display magnification is 1, the CPU 34 obtains regions (RECT2[i]) on the image data of the page memory 40 corresponding to NW regions (RECT[i]) on the display window Wa, since no arithmetic error is generated. Accordingly, the image data in regions (RECT2[i]) on the page memory 40 is directly transferred as it is to image regions of the display memory 42 corresponding to NW regions (RECT[i]) on the display window Wa and stored therein. The image data stored in the image regions of the display memory 42 is thus displayed on the window Wa of the CRT display device 24.

When the number of rectangular regions is 1 (NW=1), only one rectangular region which is not in contact with another regions is obtained, and the CPU 34 obtains regions (RECT2[i]) on the image data of the page memory 40 corresponding to the NW regions (RECT[i]) on the display window Wa without using the work memory 42*a*. The image data of the regions (RECT2[i]) on the page memory 40 is enlarged or reduced and stored in the image regions of the display memory 42 corresponding to the NW regions (RECT[1]) on the display window Wa. The image data stored in the image regions of the display memory 42 is thus displayed on the window Wa of the CRT display device 24.

As described above, when part of the target window Wa is shielded from the other window Wb, the number of rectangular regions of the unshielded part thereof is more than one, and an enlarged or reduced original image is displayed on the window, image data is first enlarged or reduced and transferred to the work memory 42*a* having the same size as that of the target window Wa. Then, image data stored in the work memory corresponding to the unshielded part is transferred to the display memory at a magnification of 1, thereby eliminating a draWback of causing a shift between two rectangular images on the window.

When image data is displayed on a window having the same size as that of the image data, it is possible to directly transfer the image data from the image memory to the window without using the working memory while keeping the size unchanged. When an unshielded part of the display window is a single rectangular region, an enlarged or reduced image can be transferred from the image memory to the window without using the work memory. Without adding any addition processing, an image can be displayed very clearly and quickly without causing any shift between two regions.

In the above embodiment, the work memory 42*a* is included in the display memory 42. However, it can be included in the main memory 38.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A method for displaying an image on a display area capable of displaying first and second overlapping windows, wherein said second window overlaps said first window such that said first window includes a non-overlapped area, said method comprising the steps of:

storing image data having a first size in a page memory;

dividing said non-overlapped area of said first window into at least one rectangular area if said first window is overlapped by said second window when said image data having its size modified from said first size to a second size is displayed on said first window;

extracting a portion of said image data corresponding to said non-overlapped area of said first window from said page memory, modifying said portion of said image data extracted from said page memory from said first size to said second size, and storing said portion of said image data modified to said second size in a display memory, if non-overlapped area of said first window includes only one rectangular area;

modifying said image data stored in said page memory from said first size to said second size and storing said image data having said second size in a work memory, if said non-overlapped area of said first window includes at least two rectangular areas; and extracting said image data corresponding to said non-overlapped area including at least two rectangular areas of said first window from said work memory, said image data extracted from said work memory having said second size, and storing said image data having said second size extracted from said work memory in said display memory.

2. A method for displaying an image on a display area as defined in claim 1, further comprising the step of:

displaying said image data stored in said display memory.

3. A method for displaying an image on a display area as defined in claim 2, wherein said displaying step includes the steps of:

dividing said image data stored in said display memory into rectangular regions corresponding to said at least one rectangular area of said first window; and displaying each rectangular region of said image data stored in said display memory in its corresponding rectangular area of said non-overlapped portion of said first window.

* * * * *